United States Patent [19]

Chase

[11] 3,949,991

[45] Apr. 13, 1976

[54] BOARD GAME APPARATUS

[76] Inventor: Michael Dennis Chase, R.R. 1, Box 76A, South County Trail, Exeter, R.I. 02822

[22] Filed: Feb. 7, 1974

[21] Appl. No.: 440,292

[52] U.S. Cl. 273/134 AC; 273/134 AD; 273/134 C; 273/134 D

[51] Int. Cl.[2] ..... A63F 3/04

[58] Field of Search ..... 273/134

[56] References Cited

UNITED STATES PATENTS

| | | | |
|---|---|---|---|
| 940,855 | 11/1909 | Clemens | 273/134 AC |
| 1,348,335 | 8/1920 | Thompson | 273/134 AC |
| 3,114,551 | 12/1963 | Ovitz | 273/134 AC |
| 3,362,715 | 1/1968 | Hartpence | 273/134 AC |

FOREIGN PATENTS OR APPLICATIONS

| | | | |
|---|---|---|---|
| 915,550 | 1/1963 | United Kingdom | 273/134 AC |

*Primary Examiner*—Delbert B. Lowe
*Attorney, Agent, or Firm*—William Frederick Werner

[57] ABSTRACT

A game board and appurtenances represent various aspects of an educational geographical enterprise and of an educational world finance enterprise. The object of the game is to acquire world domination through acquisition of various countries or continents as shown on a map of the world by means of purchase when permitted. The apparatus includes country and continent indicators and playing pieces. Dice provide the number of spaces for movement of the playing piece along a designated path along the game board. Certain designated spaces bear indicators of a country or continent available for purchase. Instruction cards of varying type are included as well as quantities of distributed play money used for the purchase of countries or payment of penalties.

4 Claims, 11 Drawing Figures

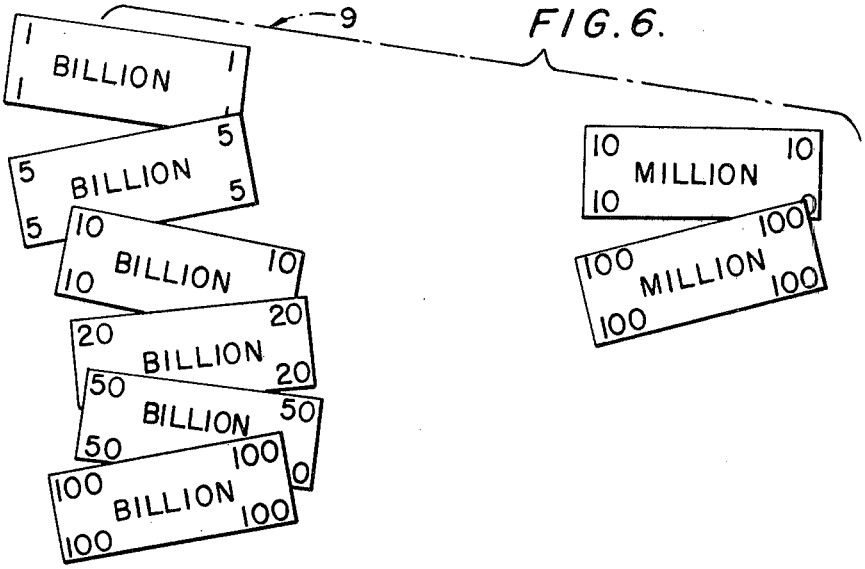

FIG. 6.

FIG. 7.

| | COUNTRIES | | ABBREVIATIONS | | RESALE VALUES |
|---|---|---|---|---|---|
| N. AMERICA | UNITED STATES | = | U. S. | = | 15 BILLION |
| | CANADA | = | CAN. | = | 10 BILLION |
| | MEXICO | = | MEX. | = | 10 BILLION |
| | SOUTH AMERICA | = | S. AM. | = | 10 BILLION |
| | AFRICA | = | AFR. | = | 15 BILLION |
| EUROPE | ENGLAND | = | ENG. | = | 12 BILLION |
| | GERMANY | = | GER. | = | 12 BILLION |
| | FRANCE | = | FRA. | = | 10 BILLION |
| | DENMARK | = | DEN. | = | 10 BILLION |
| | SWEDEN | = | SWE. | = | 10 BILLION |
| ASIA | SAUDI ARABIA | = | S. AR. | = | 12 BILLION |
| | INDIA | = | IND. | = | 12 BILLION |
| | RUSSIA | = | RUS. | = | 10 BILLION |
| | CHINA | = | CHI. | = | 10 BILLION |
| | KOREA | = | KOR. | = | 10 BILLION |
| | JAPAN | = | JAP. | = | 10 BILLION |
| | AUSTRALIA | = | AUS. | = | 10 BILLION |

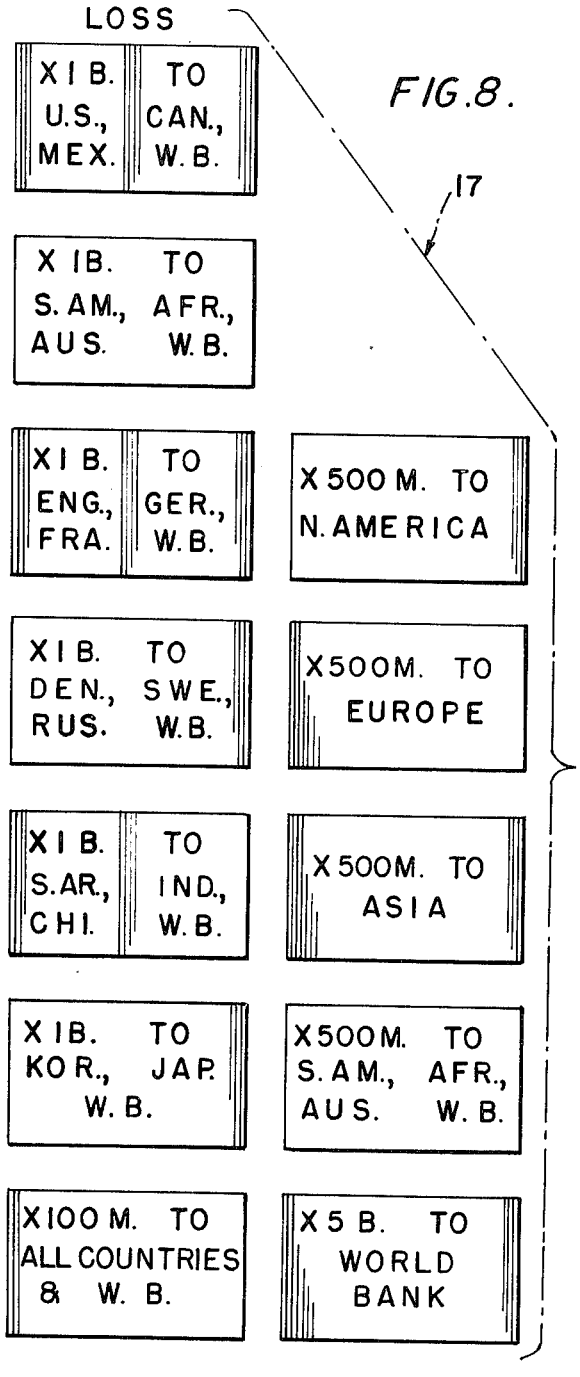
FIG.8.
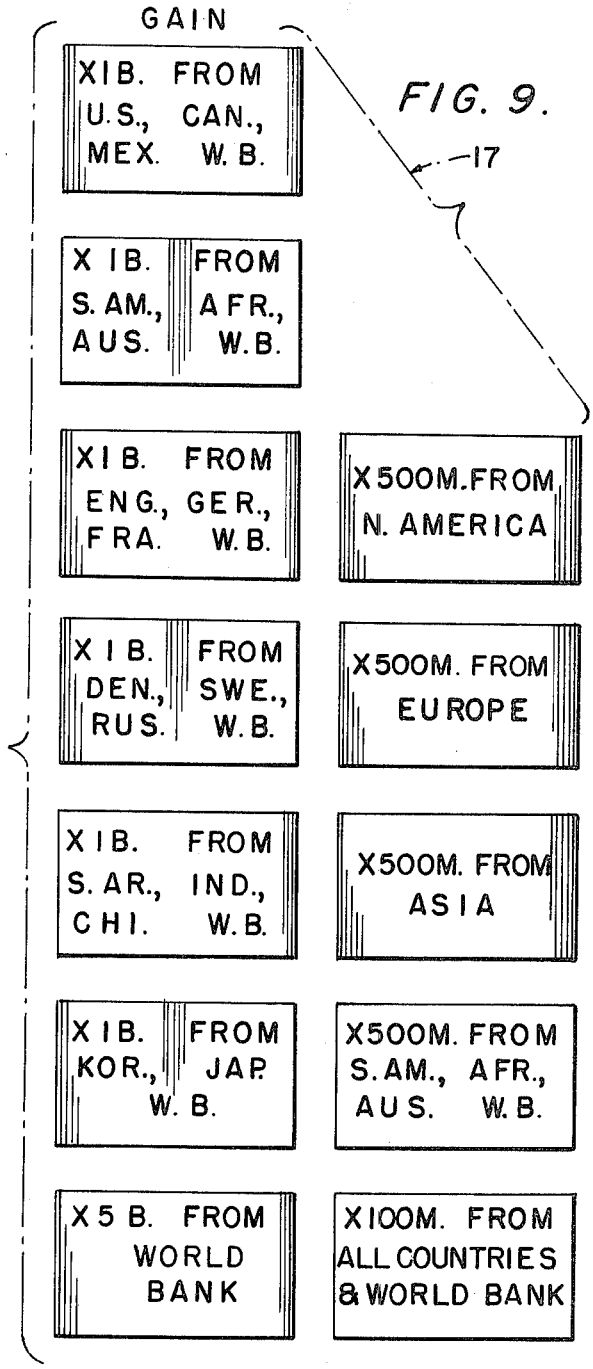
FIG. 9.
FIG.10
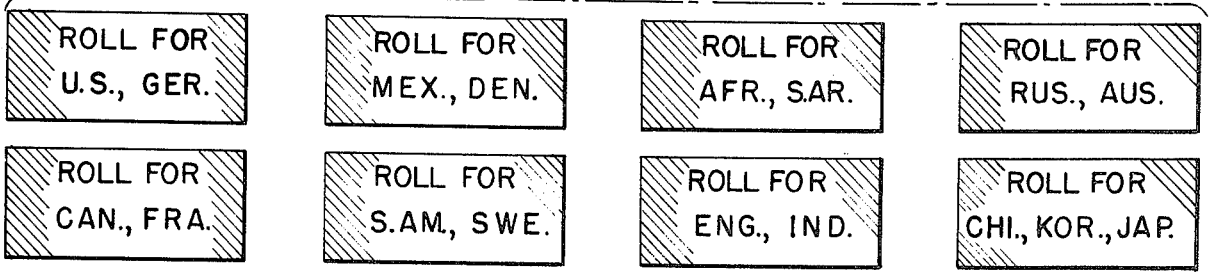

BOARD GAME APPARATUS

SUMMARY OF THE INVENTION

A game board is provided having imprinted thereon a map of the world. The map has a pathway composed of contrasting red dots, green dots, and special designated spaces bearing indicators. A playing piece is employed which is adapted to follow the said pathway step by step, in accordance with the number thrown from a die. The game includes initial distribution of a quantity of money to all of the players. Also, instruction cards are used under certain circumstances. The countries or continents over which the path meanders may be purchased under certain conditions. A World Bank is a silent participant, which itself may be purchased and used. Loans are contemplated from the World Bank.

The object of the game is to acquire all of the countries, and in doing so achieve victory as the winner of the game. On the other hand, all but one of the players may be eliminated due to said players becoming bankrupt as play progresses. Final bankruptcy is deemed as being grounds for elimination. The last survivor will be the winner who also will have acquired all of the countries.

BRIEF DESCRIPTION OF THE DRAWINGS

FIG. 6 is a plan view of several pieces of large denomination paper currency employed in playing the new game.

FIG. 7 represents a list of values in monetary terms for various countries and continents.

FIG. 8 is a plan view of several playing cards incorporating thereon various instructions whereby the player receiving one of such card, is obligated to make certain payments.

FIG. 9 is a plan view of several playing cards incorporating thereon various instructions whereby the player receiving one of such cards will receive certain payments.

FIG. 10 is a plan view of several playing cards incorporating thereon instructions with regard to one or more steps to be taken.

DETAILED DESCRIPTION OF THE INVENTION

Figure 3:
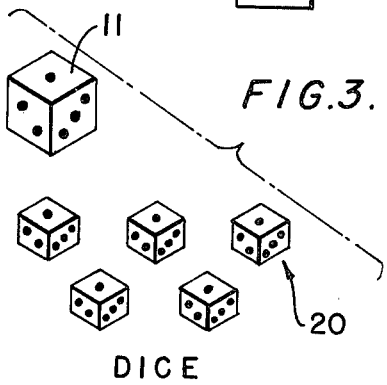
FIG. 3 is a perspective view of five small dice and a single larger die.
Figure 5:
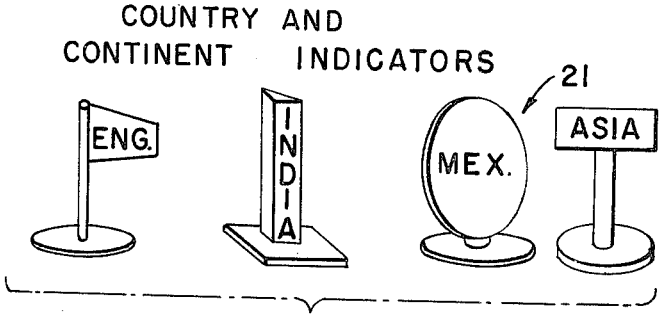
FIG. 5 are perspective views of country and continent indicators.
Figure 11:
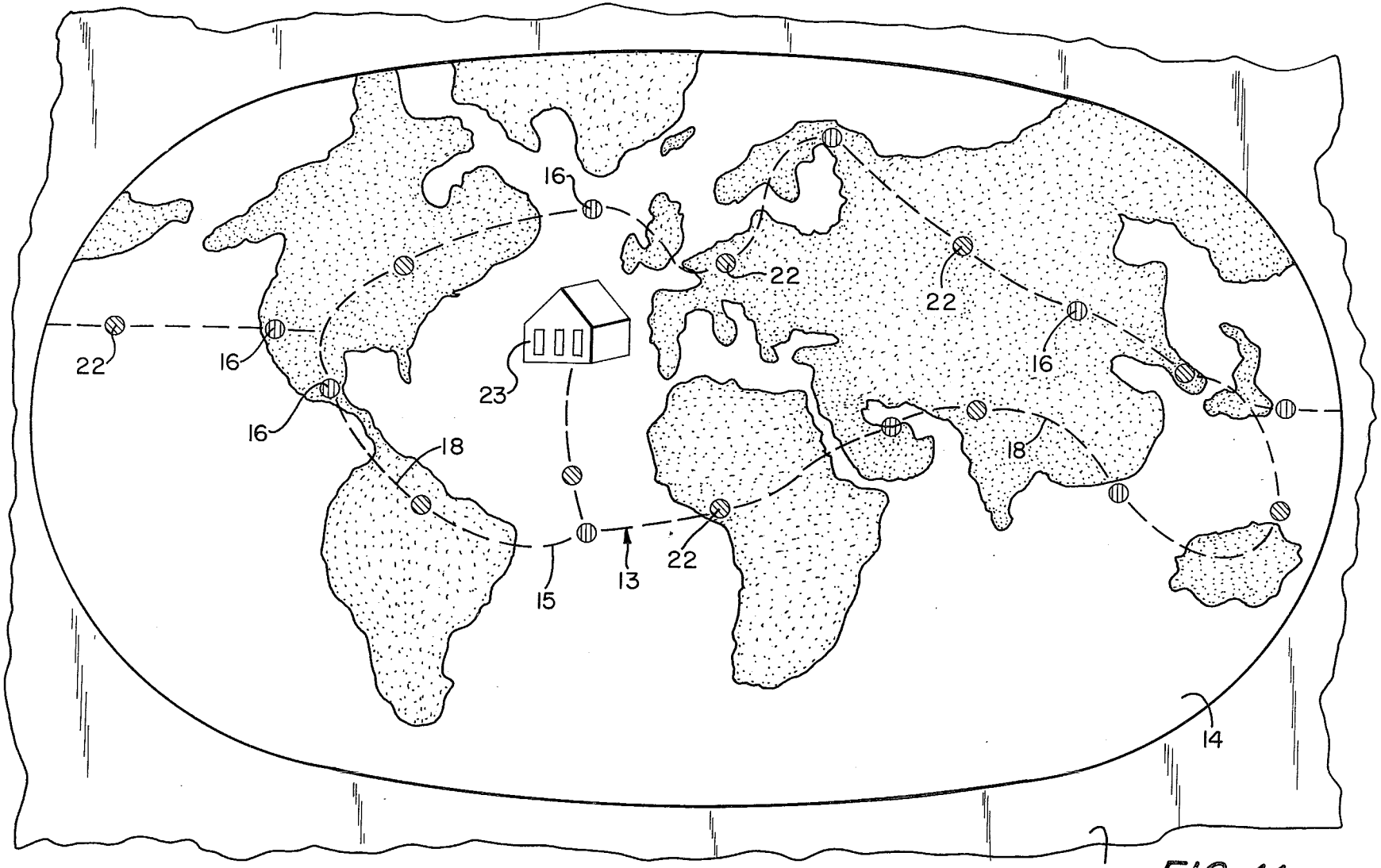
FIG. 11 shows a portion of FIG. 1 on an enlarged scale.

Before the beginning of the game, it is suggested that the player must read the rules. Now, turning to the drawings for a better and complete understanding of the invention, each player is required to roll one die 11, as seen from FIG. 3. A single playing piece 12 is utilized to be moved along a continuous path 13 in a world map 14 of the game board, shown, generally, by reference numeral 10. It will be seen that the path 13 consists of a plurality of short lines 15 defined as dashes. Periodically these lines are spaced by dots 16 and 22 of contrasting colors, such as red and green and distributed along the path. Certain resting spaces 18 are also present which represent the particular country or continent associated therewith and support the markers (FIG. 5) representing such countries and continents. The path 13 passes through the said various countries or continents of the world. Each country or continent has an indicator thereon as shown by FIG. 5.

Each player begins the game with 100 billion dollars. The play money 9 is shown by FIG. 6. Each country or continent begins the game with 50 billion dollars which is then obtained when the country is acquired.

The path 13 from the U.S. to Japan ends on the far left of the game board and picks up on the far right. The playing piece 12 may change direction at intersections of the paths as seen from the game board.

The player who rolled the die moves the piece 12 the same number of dashes as represented on the die. The red dots 16, green dots 22 and resting spaces 18 also count for one step so that the piece 12 may, in fact, come to rest on such a dot or space. When it is a red dot, a card must be drawn from the red dect 17 as exemplified by FIGS. 8 and 9. FIGS. 8 and 9 form one deck. So that all the players are apprised of the instructions printed on the card, the player making the selection should give evidence of the instructions as by reading them out loud to all of the other players. The instructions are then followed.

The red deck cards 17 may be of the loss type (FIG. 8) or of the gain type. (FIG. 9) When the loss type, the player multiplies the number on his die as a result of his last throw by the number indicated on the selected red card. He then gives this amount of money to the countries, continents or World Bank is indicated or to the owner thereof. When a gain card is selected, the converse occurs and the player receives the money indicated from the countries, continents or World Bank.

Figure 1:
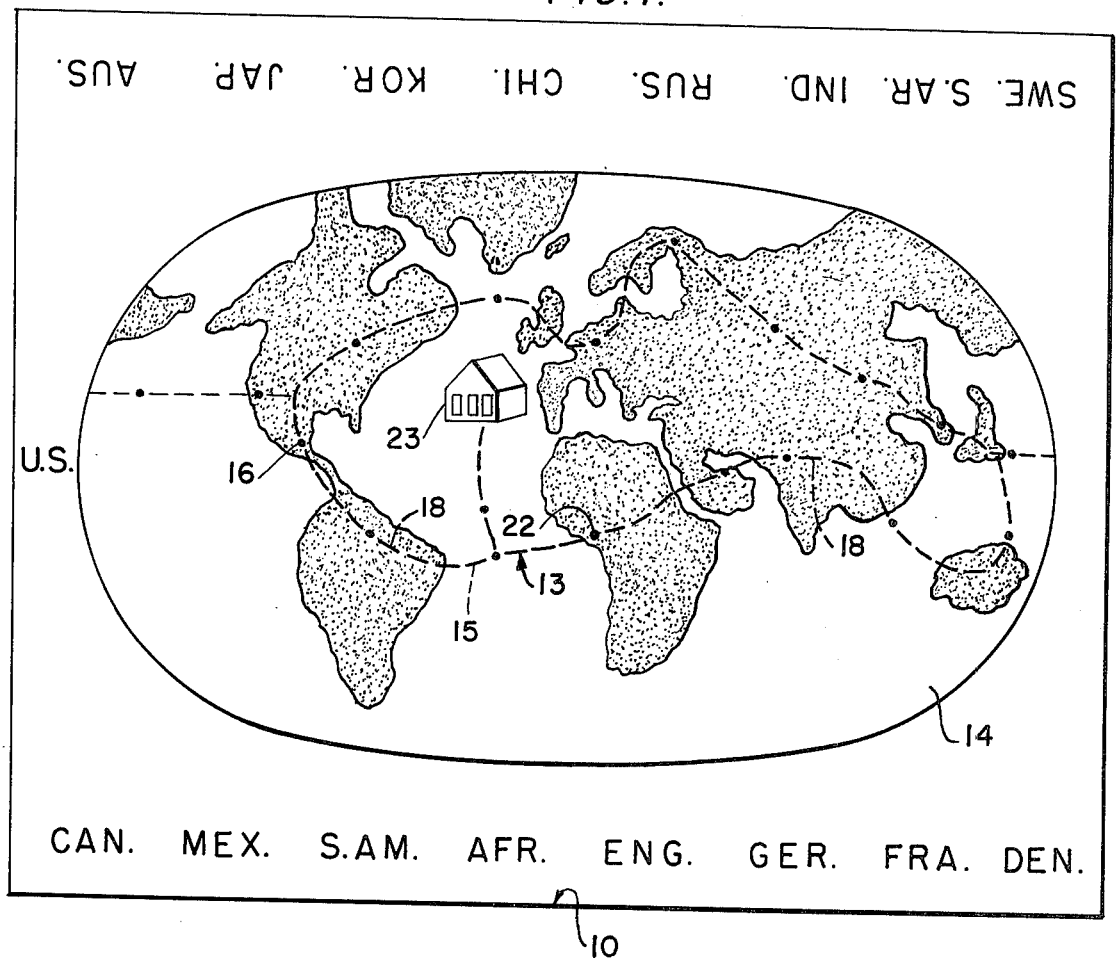
FIG. 1 depicts the game board with a world map printed thereon and setting forth a path over which a playing piece is to be moved.

Also, as stated, along the path over the countries in FIG. 1 are special spaces 18. When a piece 12 comes to rest in such a space, the particular designated player may be thereby in a position to acquire that country or continent.

Figure 2:
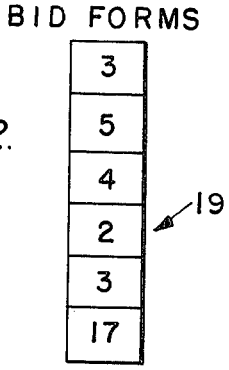
FIG. 2 shows a bid form employed in playing the game.
Figure 4:
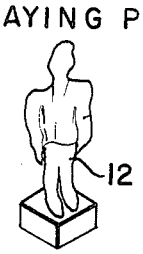
FIG. 4 is a perspective of a specific type of playing piece.

The country or continent is acquired by the following procedure. Each player writes down on a form 19, as seen from FIG. 2, provided therefor, a guess of the five numbers and the sum total thereof that the player believes will appear on the five small dice 20, shown by FIG. 3. The guessed at numerical information is made available to all the players as by displaying the forms 19 on the playing table, for instance. The five dice 20 are then rolled by the player whose turn it was that resulted in the piece 12 landing on the space 18. The player possessing that number on his form, or closest to it, acquires the country under the piece 12 by paying 1 billion dollars multiplied by the sum total of the five dice to the World Bank. The acquiring owner of the country or continent removes the country or continent indicator or symbol 21 therefrom. The other or losing players pay one-quarter — to the nearest million — of the total sum of the five rolled dice to the player who acquired the country. In the event of a tie, the two or more players involved in such tie repeat the prior performance until there is a winner at this level. Furthermore, the acquirer of the country is enabled to take the money that may be held by that country in its treasury.

In the foregoing, the World Bank 23 was mentioned. It is pointed out that it is a participant in the playing of the game, but as a silent partner as it cannot throw the dice or physically move the piece 12. The World Bank may also acquire a country as it is given a fixed estimate for the purposes intended when the five small dice 20 are rolled. The fixed estimate is arrived at by throwing the five small dice 20 prior to beginning the game. The total of the dice 20 can be established as the fixed estimate. As the estimate is fixed, the World Bank is arbitrarily deemed to win when it is involved in a tie with actual players.

The game continues in the manner aforementioned, with each player taking a turn until all of the countries or continents have been duly acquired.

As mentioned before, along the heretoforementioned path are positions designated with, for instance, a green dot 22. Up until the sequence of activity when all of the countries have been acquired, these green dots 22 have been considered normal for purposes of movement. Once all of the countries have been acquired the second phase of the game results. Now, having the piece 12 come to rest on a green dot 22 requires drawing a card from a green colored deck, the indicia imprinted thereon being illustrated by FIG. 10. The color green is merely selected by way of contrast to the red deck, as illustrated by FIGS. 8 and 9. The instructions printed on the card taken from the green deck are read aloud and are then followed by the players. From the instructions there is a roll of the type aforementioned for the particular country or continent.

Also, once all the countries have been acquired, it is the players' option at any convenient time to enter an attempt at acquiring the World Bank, and, of course, its money and any countries held by it. However, only those players in possession of one or more countries may participate in such an incursion on the World Bank. The World Bank is acquired in similar manner as countries previously acquired, that is, by establishing an estimate and then rolling the five small dice 20. However, the acquisition is made somewhat more difficult by the need for a player to win three out of five of the rolls. The ultimate winner, then, takes possession of the World Bank, its money, and its countries.

The playing of the game then continues as before. As the playing piece comes to rest on the same space by which a country or continent was acquired during the first phase, the World Bank or the owner thereof challenges the owner of the country for ownership of that particular country. The two players make the required estimate or, if the World Bank is not owned by a player, the initial fixed estimate is employed. Possession is either maintained or taken by the World Bank or the owner thereof, as in phase one of the play. This manner of play continues around the board for one entire circumference, at which time, if the World Bank owner has not acquired all the countries, the World Bank is up for acquisition in the same manner as heretofore mentioned by those possessing countries. It will be seen that each new acquirer of the World Bank maintains possession for one entire circumference of play at which time it is bid for again, if during the tenure by the current owner all of the countries have not been acquired. In the event that the World Bank current owner maintains possession after the mentioned play through one circumference and subsequent re-bid, that owner, by virtue of a successful defense for ownership, is able to keep possession until the termination of the game or until he loses all the countries in his possession, including those of the World Bank. Should this occur, the World Bank may then be acquired by another as heretofore. On the other hand when the World Bank takes possession of all of the countries, the game is over and the owner of the World Bank is declared the winner.

In play, each time the World Bank is taken, the new owner receives from all other players the sum of 5 billion dollars plus another 5 billion dollars for each country owned by them. The World Bank is deemed to have unlimited funds. Players may contract loans whenever needed at 20% interest, payable upon initial acquisition of the World Bank. Records should be kept of all transactions.

On the occasions when a player cannot cover his financial obligation, the player must sell a country owned by him at the assigned resale values as seen from FIG. 7. The country may be sold to the World Bank. However, if another player or players desire possession, the five small dice 20 may be rolled as before. The winner of the toss pays one billion times the total of the dice plus the resale value, but no quarter payments are necessary at this juncture. Again, the World Bank may intervene through its previously established fixed estimate.

In the event a player is in the unfortunate position of possessing no assets — money or countries, he is considered to be in a bankrupt situation and may stay in the game for only one more round of tossing of the die 11. If the player has not been successful in acquiring any assets within the round, he is deemed to have retired from the game.

Whenever a country is passed and not acquired, each player and the World Bank must give 5 billion dollars to the country, which is acquired later by the acquirer of the country.

When the players vie for a country after the World Bank has been acquired by one of the players, the acquirer of that country does not need to pay any money for that country but the other players pay the acquirer 1 billion dollars times the total of the five dice.

Also, it is pointed out that when the World Bank challenges for ownership of a country, the World Bank owner has the prerogative of two estimates or bids, namely, his own as a player and the fixed estimate already established for the World Bank. The acquirer of the country receives the sum of 1 billion dollars times the total of the five small dice 20 from the players still in the game who participated in the chance for acquisition.

What is claimed is:

1. A game apparatus comprising a game board, a plurality of rectangularly shaped pieces of paper having monetary designations thereon whereby said pieces of paper constitute play money, said game board having indicia imprinted thereon representing a map of the world, said game board having a path divided into a plurality of dash lines and dots interspersed interspersed at intervals among said dash lines, said dots (alternating in two) having two different colors, some of said dash lines bearing a country or continent thereon and adapted and constructed to overlie said game board at said dashes, whereby a country or continent on said map may have a marker positioned thereabove, a first numbered die, five numbered dice smaller than said first die, a playing piece adapted and constructed to be moved along said path in accordance with a number on said first die thrown by one player, whereby said playing piece is brought to rest on one of said dash lines or dots a first set of cards in one of said two different dot colors, each card in said set bearing an instruction with regard to paying or receiving a quantity of play money when said playing piece overlies a dot of the same color as the cards;

when a playing piece comes to rest upon a marker bearing dash line, a plurality of forms are distributed to all players for recording estimates made by each player, prior to rolling the five smaller dice by said one player, of the total presented when the said five smaller dice are thrown, the player possessing that estimate closest to the total of the five dice acquiring the country or continent under the playing piece by paying a preselected amount of play money to a world bank, and removing the marker from the board, the world bank being a silent partner which can acquire countries or continents when the five dice thrown by a player total a preselected sum arrived at prior to the start of the game when the five dice are thrown to arrive at said sum, a second set of cards in the other of two different dot colors, each card in said second set bearing a set of instructions with regard to rolling of said five smaller dice for the purpose of acquiring one or more countries or continents.

2. The game apparatus of claim 1, wherein the playing piece takes the form of a statue.

3. The game apparatus of claim 2, wherein symbols in upstanding positions on bases constitute the markers to identify a country or continent.

4. The game apparatus of claim 3, wherein the cards of the first set of cards are larger in size than those of said second set of cards.

* * * * *